United States Patent [19]

Jung

[11] Patent Number: 4,958,819

[45] Date of Patent: Sep. 25, 1990

[54] LAYING MACHINE

[75] Inventor: Rolf Jung, Waiblingen, Fed. Rep. of Germany

[73] Assignee: Krauss u. Reichert GmbH & Co., Fed. Rep. of Germany

[21] Appl. No.: 286,424

[22] Filed: Dec. 19, 1988

[30] Foreign Application Priority Data

Dec. 24, 1987 [DE] Fed. Rep. of Germany ..... 3744034

[51] Int. Cl.[5] ..... B65H 29/46

[52] U.S. Cl. ..... 270/31; 270/39; 493/13; 493/22; 493/24; 493/937

[58] Field of Search ..... 270/30, 31, 39; 493/10, 493/13–15, 17, 22, 24, 937

[56] References Cited

U.S. PATENT DOCUMENTS

| | | | |
|---|---|---|---|
| 4,460,350 | 7/1984 | Mittal | 493/450 |
| 4,494,948 | 1/1985 | Teyssier | 493/412 |
| 4,572,495 | 2/1986 | Stumpf | 270/31 |

FOREIGN PATENT DOCUMENTS

| | | | |
|---|---|---|---|
| 3008508 | 9/1981 | Fed. Rep. of Germany | 270/31 |
| 58-202258 | 11/1983 | Japan | 493/937 |
| 59-48353 | 3/1984 | Japan | 493/937 |
| 1068364 | 1/1984 | U.S.S.R. | 270/31 |
| 2023201 | 12/1979 | United Kingdom . | |

*Primary Examiner*—Edward K. Look
*Assistant Examiner*—Therese M. Newholm
*Attorney, Agent, or Firm*—Kramer, Brufsky & Cifelli

[57] ABSTRACT

In order for a laying machine for laying out a fabric web comprising a fabric web guide mechanism for drawing the fabric web off a fabric reel and laying it out as a fabric layer, including a fabric feed device for feeding the fabric web in accordance with the speed of the laying machine, and also comprising a tension relief control means, to be designed as simply as possible from a structural point of view, it is proposed that the fabric web loop be arranged between the fabric feed device and the laid-out fabric layer, that the fabric web loop be formed by a bend of free-falling fabric web piece in a direction extending transversely to the direction of fall, and that the sensing barrier detect a change in the length of the arc of the bend through displacement of the freely hanging bend.

17 Claims, 4 Drawing Sheets

LAYING MACHINE

Figure 1:
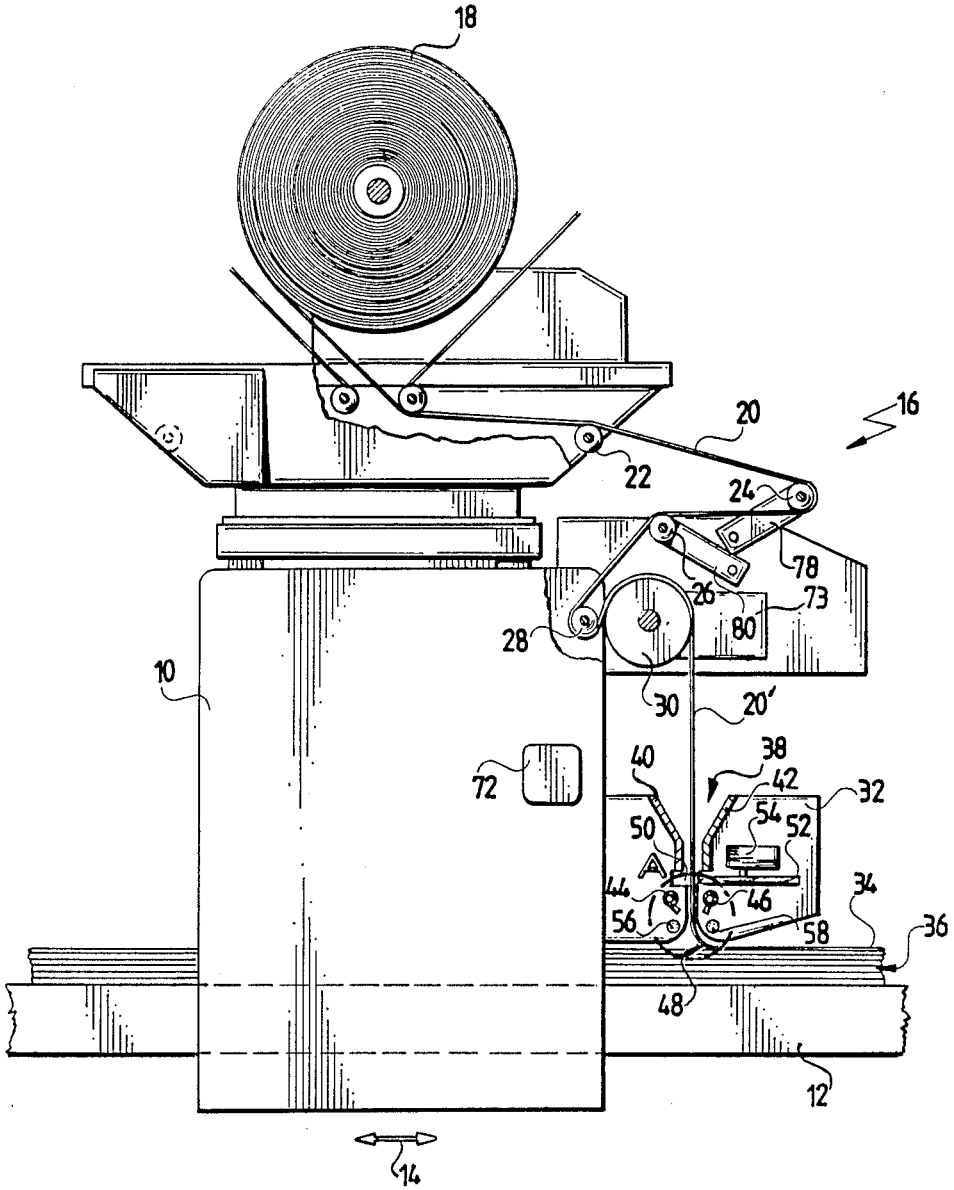

The invention relates to a laying machine for laying out a fabric web comprising a fabric web guide mechanism for drawing the fabric web off a fabric reel and laying it out as a fabric layer, including a fabric feed device for feeding the fabric web in accordance with the speed of the laying machine, and also comprising a tension relief control means for detecting by means of at least one non-contacting sensing barrier a fabric web loop formed in the course of guidance of the fabric web with respect to its deviations from a normal size.

Such a laying machine is known from German Offenlegungsschrift (unexamined Patent Application) No. 2 922 930. In this laying machine, a U-shaped, freely downwardly hanging fabric web loop is provided upstream from the fabric feed device and its extent in the direction of fall can be detected by two light barriers oriented parallel to a tangent at the lowest point of the U-shaped loop and serving as non-contacting sensing barrier.

Such a tension relief control means does enable the fabric web to be fed to the feed device free of tension in the longitudinal direction, but it has the disadvantage that slip occurring in the region of the fabric feed device cannot be detected and, therefore, tensions can occur in the longitudinal direction of the fabric web in the region of the fabric web guide between the fabric feed device and the laid-out layer by the fabric web not being able to be fed at exactly the speed corresponding to the speed of the laying carriage owing to the slip in the region of the fabric feed device not being precisely controllable.

Provision of such a freely downwardly hanging fabric web loop downstream from the fabric feed device is, however, not possible because such a fabric web loop only enables functioning tension relief control if the fabric web is fed to this fabric web loop in a defined manner and withdrawn from it in a defined manner. Hence there is always the problem that the slip in the region of the driven deflecting roll required for defined withdrawal of the fabric web is not controllable and so there is no guarantee that tension-free laying of the fabric web will be possible.

It should, furthermore, be taken into consideration that in the laying machines described at the beginning, the fabric web should be automatically threadable. In this respect, too, formation of a freely hanging fabric web loop leads to difficulties because its formation after the threading requires either displacement of the fabric reel itself, as described, for example, in German Offenlegungsschrift (unexamined Patent Application) 2 922 930, or provision of additional deflecting rolls and also a great deal of controlling technology.

The object underlying the invention is, therefore, to so improve a laying machine of the generic kind that tension-free laying of the fabric web in conjunction with a solution involving little expenditure as regards apparatus is possible.

This object is achieved, in accordance with the invention, in a laying machine of the kind described at the beginning by the fabric web loop being arranged between the fabric feed device and the laid-out fabric layer, by the fabric web loop being formed by a bend of a free-falling fabric web piece in a direction extending transversely to the direction of fall and by the sensing barrier being arranged such that a change in the length of the arc of the bend can be detected through displacement of the freely hanging bend.

The inventive solution firstly has the advantage that the fabric loop is now arranged in the region between the feed device and the laid-out fabric layer and hence the tension relief control means automatically also compensates the slip occurring in the region of the feed device. Furthermore, owing to the different type of formation of the fabric loop, namely by it merely representing a bending of the fabric web away from the free direction of fall, the loop can still be kept stable as fabric web loop in spite of uncontrolled withdrawal of the fabric web and only undergoes deformation in accordance with the tension occurring in the longitudinal direction of the fabric web. A collapse, such as might occur in the case of a known U-shaped downwardly hanging fabric loop with undefined withdrawal of the fabric web, is not possible with the formation of the fabric web loop according to the invention.

Accordingly, the invention is to be seen in the fact that arrangement of a freely hanging fabric web loop between the fabric feed device and the laid-out fabric layer is only made possible by the different formation of the fabric web loop, namely in the form of a bend.

Owing to the fact that the fabric web hangs freely when the tension relief control means is operating and depending on the tension occurring in the fabric web, the length of the arc of the bend changes and hence the bend is also automatically displaced, substantially tension-free laying of the fabric web, containing at most a slight tension in the longitudinal direction caused by the weight of the fabric web as it hangs down in the region of the bend, is possible.

Finally, the inventive solution also has the advantage that with such formation of the fabric web loop, the fabric web can also be threaded automatically because deflection of the free-falling fabric web in a direction extending transversely to the direction of fall can be achieved with structurally or control-technologically simple means.

It is, however, particularly advantageous for automatic threading for the fabric web to be deflected in the region of the bend with respect to the direction of fall through an angle of between approximately 90 degrees and 170 degrees, but it is even more advantageous for this angle to be between approximately 90 degrees and 150 degrees.

This angle is to be understood as the angle which the inside fabric web surface with respect to the bend includes in the region of a start and an end of the bend.

The detection of the displacement of the bend required for the controlling is possible in many different ways. It is simplest for the sensing barrier to detect displacement of the freely hanging bend in a transverse direction to the direction of fall.

In a first variant for detecting the displacement of the freely hanging bend, the sensing barrier is arranged tangentially to the bend, i.e., it registers tangentially to the bend an increase or decrease therein.

To enable this displacement of the bend to be detected more precisely, it is expedient, in this first variant, for the sensing barrier to sense in the direction perpendicular to the surface formed by the fabric web a region of predetermined width and to detect which part of this region is covered by the bend.

In a second variant, the sensing barrier extends transversely to the fabric web across the entire width thereof and in the case of the length of the arc of the bend being normal is arranged on one side thereof. This arrangement of the sensing barrier has the great advantage that it saves a great deal of space because the sensing barrier now extends substantially transversely across the entire fabric web in the region of the bend and, consequently, components required for the sensing barrier can be very easily mounted, for example, on side walls which are provided in any case and, therefore, no additional holders are necessary.

In the inventive solutions described above, it may be adequate for the displacement of the bend to be detected in one direction only. In this case, the feed device must be controlled in such a way that the bend is displaced towards the side on which the sensing barrier is arranged, and when the sensing barrier is reached, the tension relief control means must then drive the feed device in the reverse direction for a short time so that, in all, the bend always swings towards the side of the sensing barrier.

Since such swinging of the bend results in undesired vibrations, it is advantageous for two sensing barriers to be provided, with each detecting a displacement of the bend in each of two opposite directions. Therefore, in this case, the fabric web extends with its bend at normal arc length between the two sensing barriers and only upon a deviation from the normal arc length does one of the sensing barriers trigger corresponding regulation of the feed device.

Owing to the fact that the sensing barriers should, in order to function safely and reliably, be interrupted over as large a surface as possible, but the thickness of the fabric web is usually very slight, there exists the danger when the sensing barriers extend parallel to the fabric web across its entire width that the sensing barriers will not always reliably trigger a signal when a side edge of the fabric web crosses their detecting cross-section. For this reason, provision is made for each sensing barrier to extend at an acute angle to the surface formed by the fabric web so that the fabric web which is always displaced parallel to itself and the sensing barrier together form an angle and, therefore, the fabric web crossing the sensing barrier covers a larger detecting cross-section of the sensing barrier.

The detecting cross-section of the sensing barrier is completely covered when the angle corresponds at least approximately to an angle determined by the width of the fabric web and the width of the light beam as short sides of a right-angled triangle.

Very many different kinds of non-contacting sensing barriers are conceivable as sensing barriers but in the case of a fabric laying machine it has proven particularly expedient for the sensing barriers to be light barriers.

In the embodiments described so far, the position of the bend between the fabric feed device and the laid-out layer has not been specified in further detail. Since a laying unit is usually arranged on the laying machine between the feed device and the layer to be laid out, it has proven advantageous for the bend and the sensing barriers to be arranged in the region of a laying unit. This has the further advantage that the bend is fixedly arranged relative to the laying unit and hence the fabric web piece from the bend to the layer to be laid out always remains constant.

It has proven particularly advantageous for the bend to be arranged between a lay-out edge and the laid-out layer as it then lies immediately before the layer to be laid out and the tension relief control means is, therefore, able to compensate all conditions occurring in the course of guidance of the fabric web and resulting in deviation from the ideal feeding speed.

In another preferred embodiment in which a cut-off edge is provided in the region of the laying unit, it is advantageous for the bend to be arranged between a cut-off edge and the laid-out layer as the cut-off edge usually constitutes the last guiding element for the fabric web in the course of guidance of the fabric web.

In particular, in the inventive laying machine with automatic threading, firstly, in order not to unnecessarily complicate the automatic threading and, secondly, in order to fix the bend of the fabric web in a defined manner, it has proven advantageous for the fabric web guide mechanism to comprise a guiding element fixing the direction extending transversely to the direction of fall for formation of the bend.

In the embodiment which, within the scope of the inventive solution, is most advantageous, an arc-shaped course of the fabric web in the region of transition from the fabric web guide mechanism to the laid-out layer serves as bend forming the fabric web loop. This embodiment simultaneously uses the arc-shaped course of the fabric web in the region of transition from the fabric web guide mechanism to the laid-out layer which is provided by way of necessity in all laying machines to enable effective tension relief regulation since this arc-shaped course of the fabric web is arranged immediately before the laid-out layer and hence reflects all inaccuracies of the feeding speed of the fabric web through the fabric web guide mechanism. In addition, this embodiment saves a great deal of space as it requires no space to provide an additional bend either in the laying unit or anywhere else between the feed device and the laid-out fabric layer.

In the embodiments described so far, it has always been assumed that the bend obtains it shape from the stiffness of the fabric web itself. In the case of fabrics with little inherent stiffness, it may, however, be necessary to provide devices to act upon the bend in the direction of a maximum arc length in order to achieve a shape of the bend required for detection by the sensing barriers. On the other hand, the embodiments described above permit almost tension-free laying of a fabric web but do not enable a fabric web to be laid out with a slight tension insofar as this should be necessary. This is also possible with the devices for acting upon the bend in the direction of a maximum arc length for by means of these the bend can then be held with a defined force in the position corresponding to a normal arc length.

It is particularly advantageous for the bend to be acted upon by an air current and the devices for this purpose are preferably tubes extending transversely to the width of the fabric web with correspondingly oriented nozzles.

Figure 2:
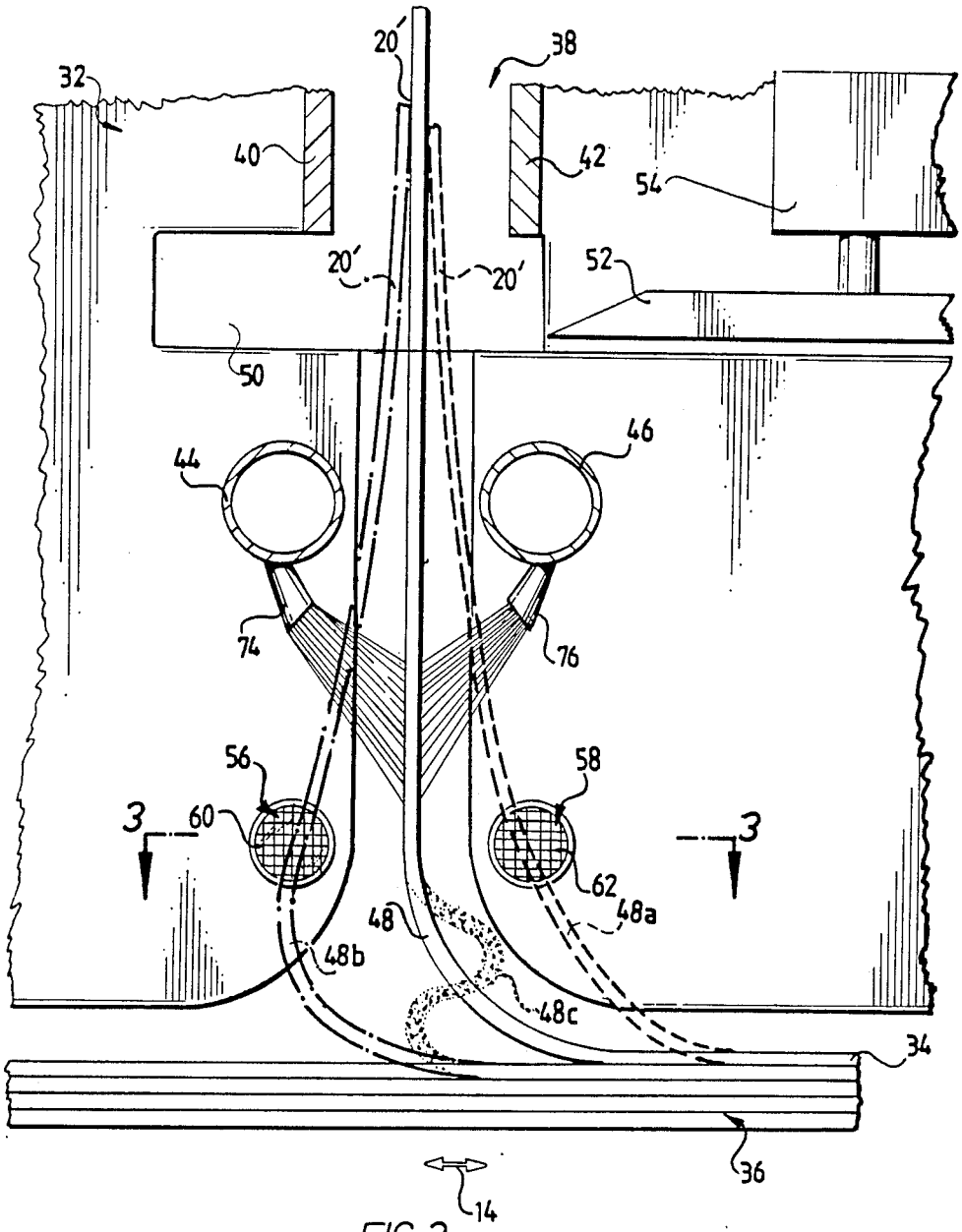
Figure 3:
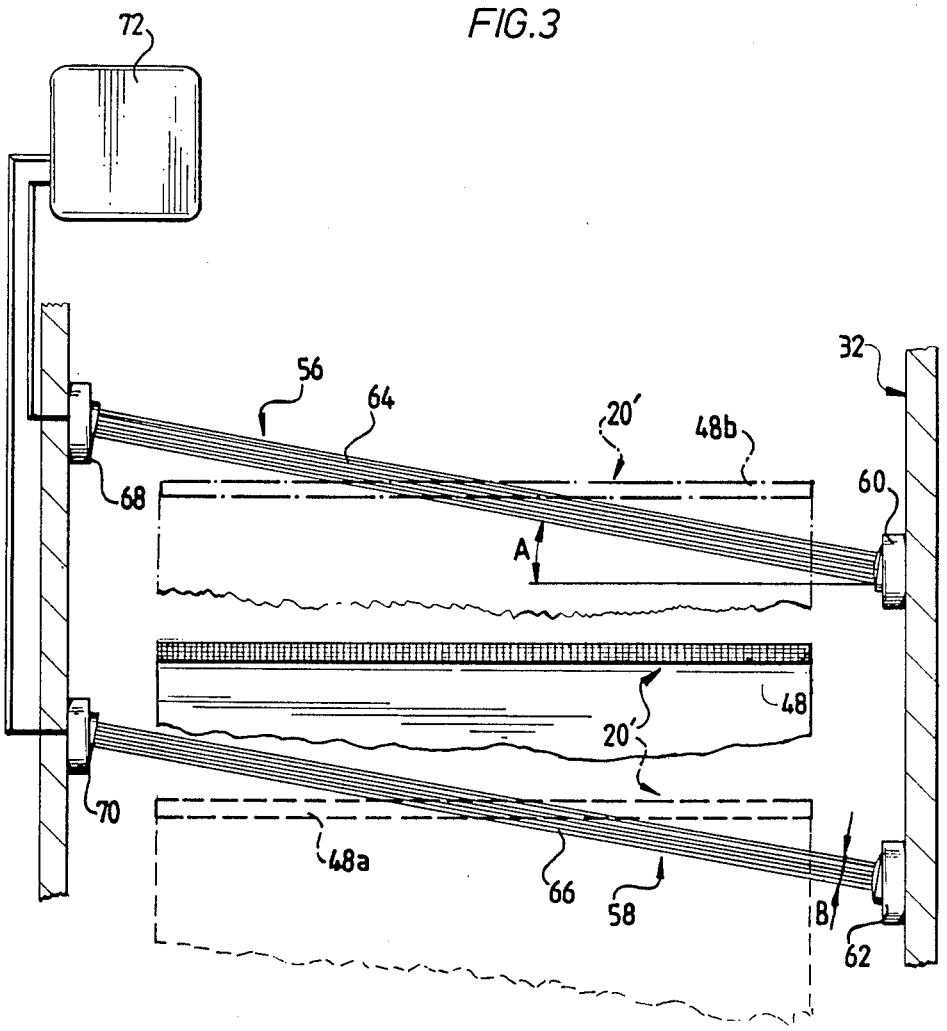

Further features and advantages of the invention are the subject of the following description and the appended drawings of embodiments. The drawings show:

FIG. 1 a partly broken-open front view of a first embodiment of an inventive laying machine;

FIG. 2 a section of area A in FIG. 1;

FIG. 3 a section along line 3—3 in FIG. 2; and

Figure 4:
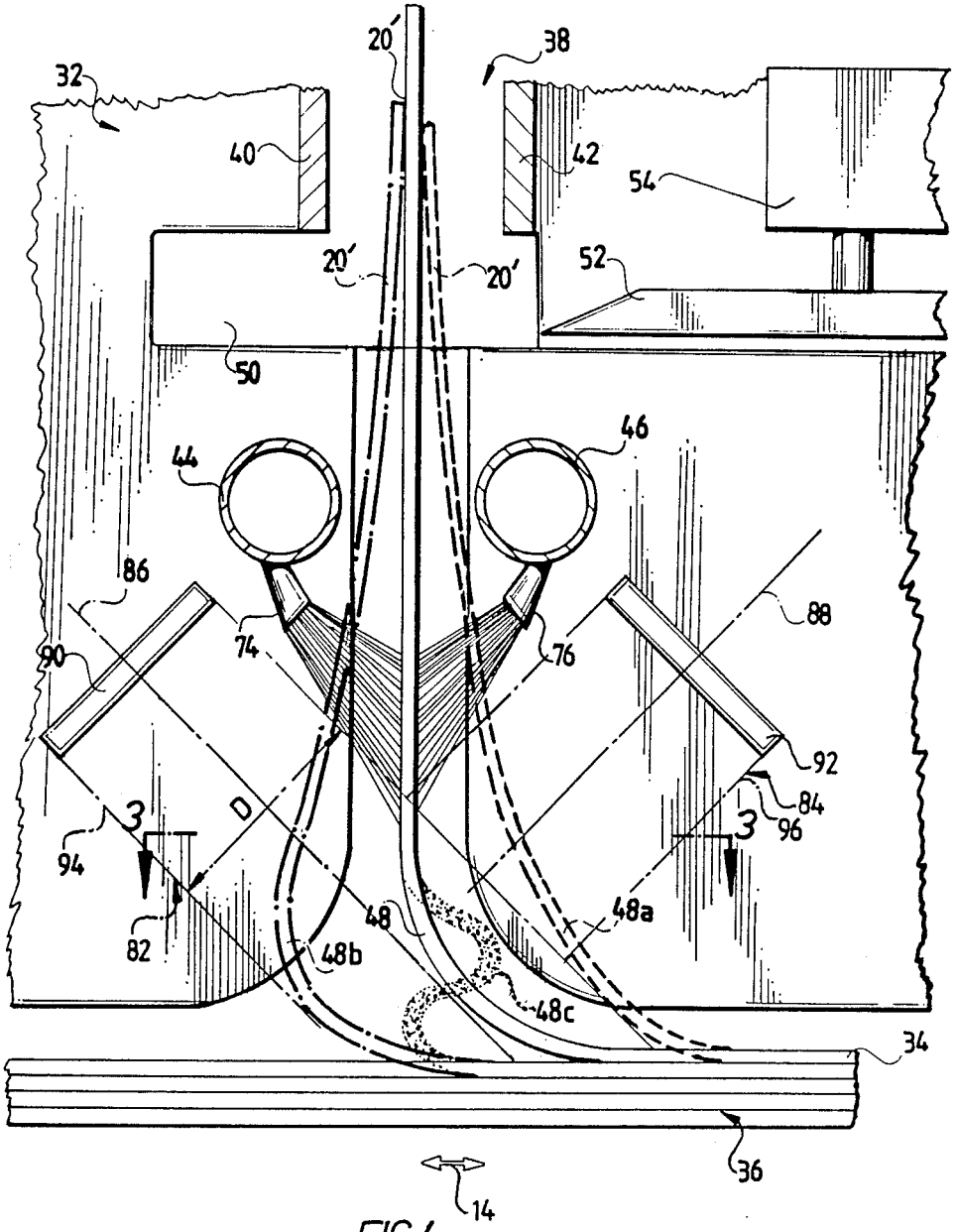

FIG. 4 a section similar to FIG. 2 through a second embodiment.

FIG. 1 shows an embodiment of a fabric laying machine with a laying carriage designated in its entirety 10 which is mounted on a laying table 12 for reciprocating motion in the direction of arrow 14. This laying carriage 10 comprises a fabric web guide mechanism designated in its entirety 16 which draws a fabric web 20 off a fabric reel 18 and guides it over deflecting rolls 22, 24, 26 and 28 to a feed roll 30 from which it is fed to a laying unit 32 and after passing through the latter is laid out as fabric layer 34 on the laying table 12 in the form of a stack 36.

The feed roll 30 is driven in dependence upon the speed of the laying carriage 10 in the direction of arrow 14 in such a way that the fabric web 20 is laid as fabric layer 34 with as little tension as possible.

The laying unit 32 is, for example, designed in such a way that the fabric web 20 falls freely through it to the fabric layer 34. For this purpose, the laying unit 32 has a fabric web guide 38 comprising two guide plates 40 and 42 of funnel-shaped, tapering configuration through which the fabric web is conducted between two guide tubes 44 and 46 arranged in spaced relation to one another below the fabric web guide 38 and serving as lay-out edge from which the fabric web then passes in the form of a bend 48 into the fabric layer 34.

For cutting off the fabric web 20 there remains between the guide tubes 44, 46 and the fabric web guide arranged thereabove a free space 50 into which a knife 52 of a cutting-off device 54 can be introduced to enable severing of the fabric web along a cut-off edge or line in the region of this free space 50.

As shown, in particular, in FIGS. 2 and 3, in the region of the bend 48 of the fabric web 20, a light barrier 56 and 58, respectively, is arranged on each side of the fabric web, viewed in the direction of arrow 14, and extends transversely across the entire width of the fabric web. As illustrated in FIG. 3, each of the light barriers 56 and 58, respectively, comprises a light source 60 and 62, respectively, from which a light beam 64 and 66, respectively, travels to a photocell 68 and 70, respectively.

In accordance with the invention, the light beams 64 and 66 are arranged so as to extend transversely across the entire fabric web 20 in the region of the bend in a plane which is parallel to the fabric layer 34. The light beams 64 and 66 can be oriented so as to also extend parallel to the fabric web 20. However, it is more advantageous for the light beams 64 and 66, respectively, to be inclined at an angle A with respect to a surface formed by the fabric web in the region of the bend 48. Assuming that the light beams 64 and 66, respectively, have a width B, the fabric web moved into one of these light beams 64 and 66, respectively, can then cover the beam in its entire width B and hence trigger a clear signal at the front side 68 and 70, respectively, which is in communication with a control means 72.

This control means 72 regulates a drive 73, shown in FIG. 1, of the feed roll 30 in dependence upon the signals transferred to it by the photocells 68 and 70, respectively.

This regulation operates as follows:

So long as the feed roll 30 feeds the fabric web 20 at precisely the speed corresponding to the speed of the laying carriage 10, the bend 48 of the piece 20 of fabric web 20 located between the feed roll 30 and the fabric layer 34 maintains its shape because the length of piece 20' is always kept constant. Hence when the length of the arc in the region of the bend 48 is normal, the piece 20' of the fabric web extends between the two light barriers 56 and 58 in such a way that neither the light beam 64 nor the light beam 66 is interrupted and both photocells 68 and 70 of the control means 72 deliver a positive signal.

If, however, the fabric web 20 is fed by the feed roll 30 at a slower speed than the speed of the laying carriage, the piece 20' of the fabric web 20 is visibly shortened and a pulling tension orientated in the longitudinal direction of the fabric web occurs in this piece 20', as a result of which the bend 48 also exhibits a shorter arc length owing to the shortening of the available fabric web 20 and is deformed into the bend designated **48*a*. In the case of the bend 48*a*, the fabric web 20 crosses the light beam 66 of the light barrier 58, as shown by broken lines in FIG. 3, and hence covers the photocell 70 which, therefore, reports a negative signal to the control means 72. From this negative signal, the control means 72 recognizes that the feed roll 30 is feeding the fabric web 20 at too slow a speed and will, therefore, increase the rotational speed of the drive of the feed roll 30**.

If the feed roll 30 feeds the fabric web 20 at a greater speed than the speed of the laying carriage, the piece 20' between the feed roll 30 and the fabric layer 34 becomes lengthened, as a result of which also a larger piece of the fabric web is available in the region of the bend 48 and, therefore, the arc length of the bend 48 is increased and, consequently, the bend 48 is deformed into the bend **48*b*, as shown in dot-and-dash lines in FIG. 2. Hence, as illustrated in FIG. 3, the fabric web 20 crosses the light beam 64 of the light barrier 56 and so the photocell 68 is covered and reports a negative signal to the control means 72, while the photocell 70 continues to report a positive signal. In this case, the control means 72, therefore, recognizes that the feed roll 30 is running too quickly and will, consequently, reduce the rotational speed of the drive of the feed roll 30**.

In this way it is possible to regulate the speed of the feed roll 30 such that the bend 48 remains between the deformed shapes **48*a* and 48*b* and so the fabric web 20 can be laid out into the fabric layer 34** free of tension.

Particularly when fabrics with a low inherent stiffness are to be laid, the problem may arise that in the event of enlargement of the piece 20' the bend 48 will not form the bend **48*b* and trigger the corresponding signal for the control means 72 but, as shown in dots in FIG. 2, will form a double fold 48*c* in the bottom region of the bend 48 and thereby compensate the length of the piece 20'. In order to prevent this, the guide tubes 44 and 46, respectively, are provided with additional air nozzles 74 and 76, respectively, which act upon the fabric web 20 in the region of the bend 48 in the direction of enlargement of this bend. In this case, the air nozzles 74 are switched off while the air nozzles 76 act upon the fabric web 20 in the region of the bend 48 and hence cause even fabrics with a low inherent stiffness to form the bend 48*b* upon enlargement of the length of the piece 20'**.

Supplementarily, in the embodiment described above, the fabric reel 18 may be provided with an additional drive so that the fabric web 20 is feedable to the feed roll 30 free of tension. This can be achieved, for example, by the deflecting rolls 24 and 26 being held on movable rocker arms 78 and 80 which react to a shortening or lengthening of the fabric web 20 between the fabric reel 18 and the feed roll 30 and control the drive of the fabric reel 18 accordingly.

During spreading in the opposite direction, the described conditions are reversed, i.e., in particular, the air nozzles 76 are switched off while the air nozzles 74 are switched on.

In a second embodiment illustrated in FIG. 4, insofar as the same parts are used as in the first embodiment, these also bear the same reference numerals and, therefore, reference is made in this connection to the description of the first embodiment.

In contrast with the first embodiment, instead of the light barriers 56 and 58 extending transversely across the fabric web 20' in the region of the bend 48, two light barriers 82 and 84 detect the displacement of the freely hanging bend 48 by observing it in its tangential direction 86 and 88, respectively. During the laying from the right to the left, as illustrated in FIG. 4, the light barrier 82 is effective to detect the position of the bend 48 in the tangential direction 86, whereas the light barrier 84 would be effective during laying from the left to the right.

Each of the light barriers 82 and 84, respectively, comprises a planar reflection detector unit 90 and 92, respectively, with integrated light source and photocell, which detects the fabric web 20' in the region of the bend 48 by reflection in a cylindrical or conical detection area 94 and 96, respectively, oriented tangentially to the bend 48. This detection area 94 and 96, respectively, has a given diameter D which, more specifically, is determined by the extent of the detection area 94, 96 in a direction extending perpendicularly to the surface formed by the fabric web 20'.

As illustrated in FIG. 4, the detection area 94 is oriented such that approximately the half of it is covered by the bend 48 in the normal position and so the detector unit 90 detects covering of half of the detection area 94 by the bend 48 in the direction perpendicular to the surface formed by the fabric web 20 .

If, in contrast, the bend is displaced to the right, as indicated in the form of broken lines by the bend 48*a*, then the detection area 94 is not covered by the bend 48*a*. If, however, the bend is displaced to the left to bend 48*b*, then the detection area 94 is completely covered by the bend 48*b*. This different covering of the detection area 94, therefore, enables the detector unit 90 to recognize whether and in what direction the bend 48 is displaced.

In the case of laying from the left to the right, the same thing functions with the detector unit 92 and the detection area 96.

The present disclosure relates to the subject matter disclosed in German Application No. P 37 44 034.9 of Dec. 24, 1987, the entire specification of which is incorporated herein by reference.

What is claimed is:

1. Laying machine for laying out a fabric web, comprising:

a fabric web guide mechanism which draws the fabric web off a fabric reel and lays it out as a fabric layer;

said web guide mechanism including a fabric feed device which feeds said fabric web in accordance with the speed of said laying machine; and a tension relief control means which by means of at least one non-contacting sensing barrier detects a fabric web loop formed in the course of guidance of said fabric web with respect to its deviations from a normal size; said fabric web loop being arranged between said fabric feed device and said laid-out fabric layer, in that said fabric web loop is formed by a bend of a free-falling fabric web piece in a direction extending transversely to the direction of fall whereby said sensing barrier detects a change in the length of the arc of said bend through displacement of said freely hanging bend; and said sensing barrier extending at an acute angle to the surface formed by said fabric web.

2. Laying machine as defined in claim 1, characterized in that said fabric web is deflected in the region of said bend through an angle of between approximately 90 degrees and 170 degrees with respect to the direction of fall.

3. Laying machine as defined in claim 2, characterized in that said fabric web is deflected in the region of said bend through an angle of between approximately 90 degrees and 150 degrees with respect to the direction of fall.

4. Laying machine as defined in claim 1, characterized in that said sensing barrier detects displacement of said freely hanging bend in a transverse direction to the direction of fall.

5. Laying machine as defined in claim 1, characterized in that said sensing barrier extends transversely to said fabric web across the entire width thereof and, in the case of the length of the arc of said bend being normal, is arranged on one side thereof.

6. Laying machine as defined in claim 1, characterized in that two sensing barriers are provided, with each detecting displacement of said bend in each of two opposite directions.

7. Laying machine as defined in claim 1, characterized in that said bend and said sensing barrier is a light barrier.

8. Laying machine as defined in claim 1, characterized in that said bend and said sensing barrier are arranged in the region of a laying unit.

9. Laying machine as defined in claim 1, characterized in that said bend is arranged between a lay-out edge and said laid-out layer.

10. Laying machine as defined in claim 1, characterized in that said bend is arranged between a cut-off edge and said laid-out layer.

11. Laying machine as defined in claim 1, characterized in that in order to form said bend, said web guide mechanism comprises a guiding element for fixing the direction extending transversely to the direction of fall.

12. Laying machine as defined in claim 1, characterized in that an arc-shaped course of said fabric web in the region of transition from said web guide mechanism to said laid-out layer serves as said bend forming said fabric web loop.

13. Laying machine as defined in claim 1, characterized in that devices are provided for acting upon said bend in the direction of a maximum arc length.

14. Laying machine as defined in claim 13, characterized in that said bend is acted upon by an air current.

15. Laying machine for laying out a fabric web, comprising:

a fabric web guide mechanism which draws the fabric web off a fabric reel and lays it out as a fabric layer;

said web guide mechanism including a fabric feed device which feeds said fabric web in accordance with the speed of said laying machine;

a tension relief control means which by means of at least one non-contacting sensing barrier detects a fabric web loop formed in the course of guidance of said fabric web with respect to its deviations from a normal size; said fabric web loop being arranged between said fabric feed device and said laid-out fabric layer, said fabric web loop being formed by a bend of a free-falling fabric web piece in a direction extending transversely to the direction of fall whereby said sensing barrier detects a change in the length of the arc of said bend through displacement of said freely hanging bend;

said sensing barrier detecting displacement of said freely hanging bend in a transverse direction to the direction of fall; and said sensing barrier extending transversely to said fabric web across the entire width thereof and, in the case of the length of the arc of said bend being normal, being arranged on one side thereof.

16. Laying machine as defined in claim 15, characterized in that two sensing barriers are provided, with each detecting displacement of said bend in each of two opposite directions.

17. Laying machine as defined in claim 15, characterized in that said sensing barrier is a light barrier.

* * * * *